United States Patent [19]

Pezzoli

[11] Patent Number: 4,834,146

[45] Date of Patent: May 30, 1989

[54] MEANS TO GUIDE THE MOTION OF A PAIR OF WEFT CARRYING GRIPPERS INSIDE THE SHED OF WEAVING LOOMS

[75] Inventor: Luigi Pezzoli, Leffe, Italy

[73] Assignee: Vamatex S.P.A., Villa Di Serio, Italy

[21] Appl. No.: 129,140

[22] Filed: Dec. 7, 1987

[30] Foreign Application Priority Data

Dec. 23, 1986 [IT] Italy ..... 22841 A/86

[51] Int. Cl.[4] ..... D03D 47/00

[52] U.S. Cl. ..... 139/449

[58] Field of Search ..... 139/441, 444, 445, 446, 139/447, 449, 134

[56] References Cited

U.S. PATENT DOCUMENTS

| | | | |
|---|---|---|---|
| 2,125,894 | 8/1938 | Dewas | 139/449 |
| 3,902,535 | 9/1975 | Jusko et al. | 139/134 |
| 4,102,363 | 7/1978 | Deborde | 139/441 |

FOREIGN PATENT DOCUMENTS

| | | | |
|---|---|---|---|
| 204274 | 12/1986 | European Pat. Off. | 139/449 |

*Primary Examiner*—Henry S. Jaudon

*Attorney, Agent, or Firm*—Young & Thompson

[57] ABSTRACT

A guide for the to-and-fro motion of a pair of weft carrying grippers inside the shed of weaving looms with continuous weft feed, of the type comprising two control straps movable in a substantially horizontal plane thanks to the action of two gearwheels with reciprocating motion, and a plurality of guide elements for the straps, aligned on the sley facing the reed and positioned perpendicularly thereto. The straps have at least one undercut groove and the guide elements are open and form pairs of bilateral guides for the straps, of which they engage the undercut groove. The guide elements are suitably hook elements, open towards the reed, and the straps project out of these elements towards the reed, the pairs of bilateral guides each operating according to at least two orthogonal planes.

6 Claims, 2 Drawing Sheets

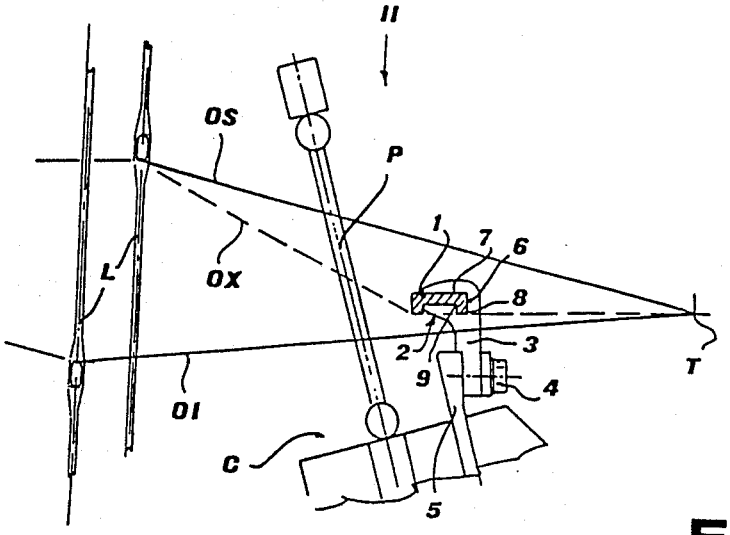
FIG.1
FIG.1A
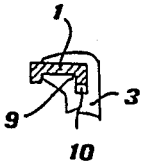
FIG.2
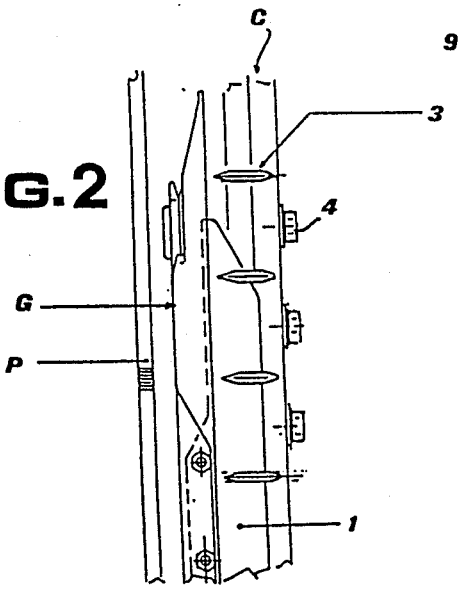

MEANS TO GUIDE THE MOTION OF A PAIR OF WEFT CARRYING GRIPPERS INSIDE THE SHED OF WEAVING LOOMS

BACKGROUND OF THE INVENTION

The present invention concerns means to guide the to-and-fro motion of a pair of weft carrying grippers inside the shed of looms with continuous weft feed, of the type comprising two control straps movable in a substantially horizontal plane thanks to the action of two gearwheels with reciprocating motion, and a plurality of guide elements for the straps, aligned on the sley facing the reed and positioned perpendicularly thereto.

It is known that modern shuttleless looms, of the type specified heretofore, still have no solve the problem of efficiently guiding the weft carrying grippers inside the shed, to guarantee that the reciprocal movements of said grippers, as well as their motion in respect of the sley and of the reed, are correct and, at the same time, to limit as far as possible the wear on the grippers, on the straps and on the other members involved in their motion, and the stresses on the warp yarns through which weft insertion is carried out.

In spite of the great number of improvements introduced in said guide means, especially in recent years, the attempts made up to date to satisfactorily meet the different and contrasting requirements of this essential aspect of the planning and construction of weaving machines, have proved unsuccessful.

A brief outline of the solutions so far adopted may help to explain the situation.

In the first shuttleless weaving looms, the motion of the grippers was guided (and it has been so far many years, and it is still so in many types of looms) by means of two parallel and close rows of elements guiding the gripper straps on both sides, respectively on the side of the reed and on the side of the fabric being formed. These elements, mounted on the sley, were in the form of opposed hooks, having substantially rectangular seats into which the straps engaged to slide with their lateral surfaces and with the ends of their upper and lower surfaces.

This arrangement soon showed its weaknesses, since the substantially correct guiding of the grippers was accompanied by:—excessive wear of the straps, determined by the particlar location and very limited extension of the area of the friction surfaces, grown soon intolerable as loom speeds were increasing;—damaging or breakage of weft yarns inserting themselves, due for instance to insufficient tension and/or to having been lowered by the upper warp years, into the seat for the strap of the guide elements of the row close to the reed, and getting caught by said elements;—and, above all, unacceptable damaging of the warp yarns subject to being: undesirably spread apart by the elements guiding the row close to the reed; easily caught (when deviated from their natural positioning in planes perpendicular to the sley) into the seats for the strap, by the guide elements of the same row, with evident risk of breakage; easily caught ("pinched"), and thus cut or seriously damaged, between the strap and the seats therefor of opposite guide elements (when loosening in proximity to pairs of said elements).

The efforts of designers have been directed to overcoming all the above drawbacks in the means guiding the motion of weft carrying grippers inside the shed of looms, gut so far, they have led only to very partial solutions ofthe problems involved.

The most interesting attempts include those made by the Applicant with the solutions provided by the European patent applications No. 84111236.0 and No. 86107378.1. In the first case, the improvement concerned the shape of the seats of the hook elements guiding the strap (for the remaining part of conventional type), in order to eliminate or reduce the risk of the warp yarns close to said elements getting caught between the seats therefor and the strap. In the second case, the improvement was to eliminate the row of guide elements close to the reed, and to leave the function of engaging and efficiently guiding both the straps and the grippers to the only remaining row of hook guide elements, suitably adapted as to shape and structure.

These arrangements, though providing an efficient solution to the specific problems faced, did not however allow overcoming the remaining drawbacks, whereby they turned out to be almost useless. In particular, the second solution did not solve the problems for which the first solution had been conceived, and viceversa. Furthermore, none of the two cited improved arrangements faced the problems of wear, which remained particularly serious in the case of the second solution, plaqued also by problems of strap hunting downstream of the gripper, while the first solution did not improve at all the drawbacks connected with irregular loose and/or lowered wefts.

Also another solution of known technique—that of the Swiss Patent No. 589.736, consisting in limiting the guide elments to a single row of elementary hooks facing the reed, to guide the gripper carrying straps only on their edge towards the fabric, on the side and from the top, letting them instead free ot slide at the bottom, on the lower warp lap, and on the other side against the reed—had not given satisfactory results, both because, especially at high speeds, the guiding of the strap and thus of the grippers was insufficiently precise (even if it eliminated the problems connected with the spreading apart of warp yarns and the catching of warp and weft yarns by the guide elements of the row - which had been abolished—close to the reed, and those connected with the "pinching" of the yarns of the lower warp lap, on which the strap was simply bearing along its path), and because it also required an operation of reed shimming and the use of special (semirigid) straps apt to keep their trajectory constant, which involved high costs.

SUMMARY OF THE INVENTION

The object of the present invention is to thoroughly solve all the problems examined heretofore, by providing improved means to guide the motion of the grippers. Such means—of the type comprising two control straps movable in a substantially horizontal plane thanks to the action of two gearwheels with reciprocating motion, and a plurality of guide elements for the straps, aligned on the sley facing the reed and positioned perpendicularly thereto—are characterized in that the straps comprise at least one undercut groove, and in that said guide elements are hook elements forming pairs of bilateral guides for the straps of which they engage said undercut groove.

Preferably, said hook elements are open towards the reed and the straps project out of said elements also towards the reed, while the bilateral guides formed by said guide elements each operate according to at least two orthogonal planes.

According to an embodiment of the invention, the straps have a substantially rectangular section with a deep groove, also of rectangular section,. formed on their lower surface, and each of said hook guide elements engages the upper surface of the straps and the lateral surface thereof far from the reed, as well as their lower surface, in correspondence of an edge thereof and into the groove, and at least one of the lateral surfaces of said groove.

According to another embodiment of the invention, a groove is provided also on the upper surface of the straps, which thus have a double-T section, and each guide element engages the lateral surface of the straps opposite the reed and the surfaces of said grooves and of their edges close to said lateral surface.

BRIEF DESCRIPTION OF THE DRAWINGS

The invention will now be described in detail, by mere way of example, with reference to the accompanying drawings, which represent some preferred embodiments thereof and in which:

FIG. 1 is a vertical section view of a weaving loom, halfway along the shed, illustrating a first embodiment of the guide means according to the invention;

FIG. 1A shows a modified construction of the hook elements of the guide means illustrated in FIG. 1;

FIG. 2 is a horizontal section view according to the arrow II of FIG. 1;

DESCRIPTION OF THE PREFERRED EMBODIMENTS

Figure 3:
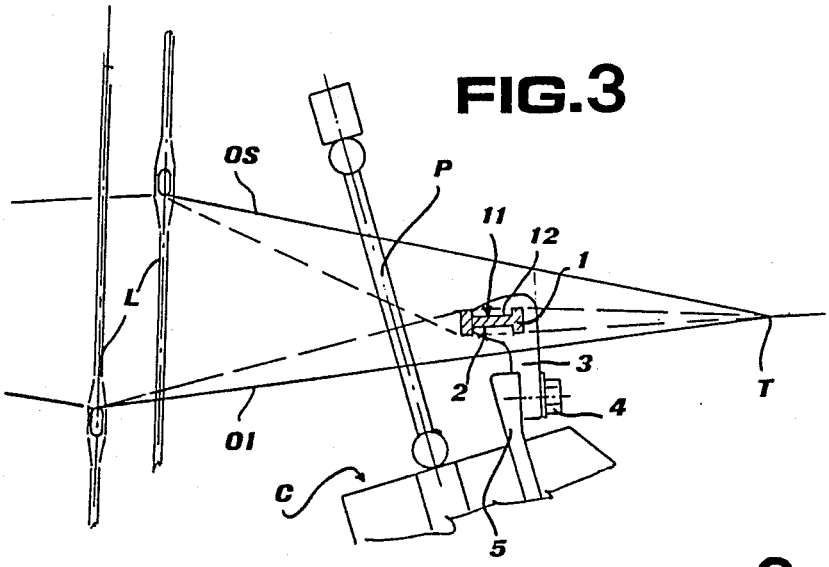
FIG. 3 is a section similar to that of FIG. 1, illusrating a second embodiment of the guide means according to the invention.

The drawings show the improved guide means according to the invention, applied to a loom of the type without shuttles and with continuous weft feed, wherein the to-and-fro motion of a pair of weft carrying grippers inside the shed is obtained thanks to a pair of control straps, movable in a substantially horizontal plane due to the action of two gearwheels with reciprocating motion. The grippers are mounted at the front end of the straps, which are guided inside the shed by a plurality of hook guide elements aligned on the sley, facing the reed and positioned perpendicularly thereto.

FIGS. 1 and 2 of the drawings show the reed P and the sley C, as well as the stitches L of the loom healds, the warp yarns of which are marked by references OS (upper warp lap) and OI (lowe warp lap). The warp yarns OS and OI form the loom shed through which the weft is inserted—between the reed P and the zone T of connection between the warp yarns, in which the fabric is formed—by a pair of grippers G, which travel parallely to the reed and exchange the weft yarn at the centre of the shed.

According to the invention, the straps 1 on which are mounted the weft carrying grippers comprise at least one undercut groove 2: in the embodiment of FIG. 1, the straps have a rectangular section and are provided with a groove, also of rectangular section, in correspondence of their lower surface.

Further according to the invention, the hook elements guiding the strap consist of plates 3, positioned in planes perpendicular to the reed P and fixed to the slep C (for example by means of screws 4 connecting them to a special tailpiece 5 of the sley). Said elements or plates comprise a seat 6 for housing the strap 1, open towards the reed and adapted to form pairs of bilateral guides for said strap, which projects out of said seat towards the reed. More precisely, the seat 6 of the guide elements 3 is formed with a flat upper surface 7, mating with the upper surface of the strap 1 over most of its length, with a flat rear side 8 perpendicular to its upper surface, mating with the right side of the strap 1, and with a stepped lower surface 9, mating with the right portion of the lower surface of the strap 1 and with its undercut groove 2. The seat 6 is open in correspondence of its front side and the strap 1 projects therefrom, out of the guide element 3, with its left side and with part of its upper and lower surfaces. The seat 6 guarantees to the strap two pairs of bilateral guides, which each operate according to at least two orthogonal planes: the upper surface and the rear side of the seat 6 form the first of said pair of guides, while the second one is formed by its stepped lower surface.

FIG. 1A shows a modified construction of the guide elements 3, according to which the bottom engagement of the strap 1 takes place merely inside its undercut groove 2, the right side of the lower surface of said strap being left free by deepening at 10 the step 9 forming the lower surface of the seat 6.

Figure 3A:
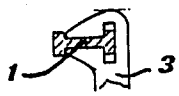
FIG. 3A shows a modified construction of the hook elements of the guide means illustrated in FIG. 3.

In the embodiment shown in FIG. 3, the strap 1 comprises, in addition to the undercut groove 2 of the previous embodiment, a corresponding upper groove 11, thereby taking up a typical double-T section. The guide elements 3 thus also have an upper stepped surface 12. This allows obtaining multiple pairs of bilateral guides for the strap. The two upper and lower stepped surfaces of the seat 6 can be so designed as to contact the right upper and lower portions of the strap 1, as shown in FIG. 3, or not to contact said portions, as shown in FIG. 3A.

The means to guide the to-and-fro motion of a pair of grippers inside the loom shed, according to the invention, allow fully and satisfactorily solving all the problems—set forth in the first part of the present description—which continuous weft feed looms have to face at present in this respect. The use of such means allows in fact obtaining in combination, a highly reliable guide for the straps, wear of the straps reduced to reasonable values and stresses on the warp yarns reduced to a minimum.

Figure 4:
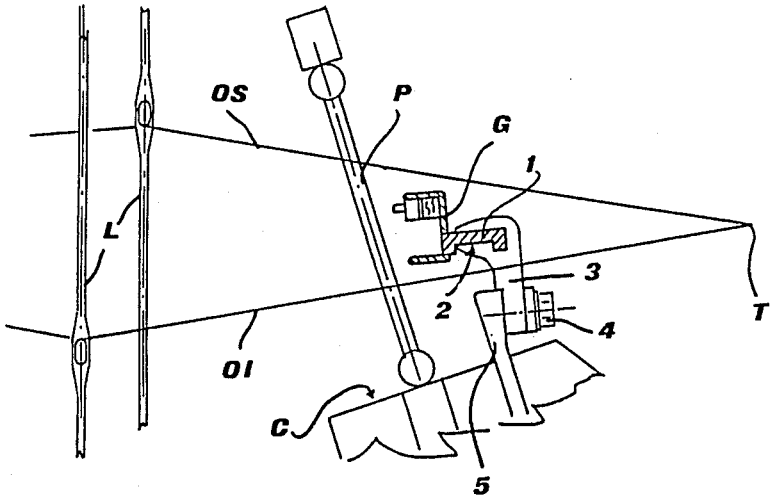
FIG. 4 shows a special arrangement of the weft carrying grippers, allowed by the guide means of the invention according to the embodiment illustrated in FIG. 1.

In fact:

The straps are guided—thanks to their undercut groove and to the corresponding shape of the seats of the guide elements—into pairs of bilateral guides, which guarantee throughout their full length inside the shed (and not only through their length in correspondence of the grippers) a motion thereof exactly along the intended trajectories, with no possility of lateral or upward deviations, nor of hunting; this guide is obtained in a very simple way from the mechanical point of view and does not require, for its constant efficiency and reliability, any particular maintenance; finally, as clearly shown in FIG. 4, it allows mounting the grippers at the ends of the straps in the best position for their insertio into the shed when this opens. FIG. 4 shows an additional advantage of the arrangement according to the invention: that of being able to lower the barycenter of the grippers to the level of the straps, thereby improving the operation and extending the life of the single components.

The wear on the strap is considerably reduced and evenly distributed, thanks to the wide extension of the friction surfaces, keeping in any case below those usually encountered by looms adopting conventional gripper motion guide means, while there is no wear of the reed or of other loom parts requiring periodical maintenance operations.

The presence of a single row of guide elements, open towards the reed and relatively spaced therefrom:

excludes any problems of irregularly positioned warp yarns getting caught: this inconvenience is in fact always determined only by thos elements close to the reed and open towards the fabric, which do not exist in the solution of the invention; the elements close to the fabric and open towards the reed do not provide this drawback, both because their parts apt to catch the yarn are far more distant from the reed and because of the positioning of these parts;

excludes any problems of loose and/or lowered weft yarns getting caught in the beating up step by the lowering warp yarns; this inconvenience is in fact again only determined by the guide elements close to the reed and open towards the fabric, which are absent in the solution of the invention; the elements close to the fabric and open towards the reed do not give rise to this drawback because the lowering of the weft yarns by the warp can only take place in counterphase with the motion of the sley which could lead said elements to catch the weft yarns;

aviods any problems of breakage or damage of the warp yarns tending to get inserted between the strap and the guide element because of being loose or anyhow not perfectly positioned; in fact, the only area where this type of yarn—for instance the yarn OX marked in dashes in FIG. 1—could insert itself between the guide element and the strap is so reduced, as to prevent the yarn from forming such a small loop as to fit into it; all the other risks are moreover avoided with the solutions of FIGS. 1A and 3A, wherein the possibility of yarn "pinching" is physically prevented thanks to the cavities created at the right end of the strap, between teh same and the seat of the guide elements;

notably reduces—thanks to the considerable distance of the guide elements from the reed—the angle to which the warp yarns are forced to spread thereby limiting the stresses on said yarns to such an extent as to preclude the possibility of breaking them and to practically eliminate any damage thereto.

I claim:

1. Means to guide the to-and-fro motion of a weft carrying gripper inside the shed of a weaving loom with continuous weft feed, of the type comprising an elongated control strap movable in a substantially horizontal plane with lengthwise reciprocating motion, a weft gripper on the end of the strap, and a plurality of guide elements for the strap aligned on the sley facing the reed and positioned in a plane perpendicular thereto; the improvement in which the strap comprises at least one undercut groove extending lengthwise thereof, and in that the guide elements are hook elements forming pairs of bilateral guides for the strap of which at least one pair engages in said undercut groove.

2. Guide means as in claim 1, wherein said hook guide elements are open towards the reed, and wherein the strap projects out of said elements towards the reed.

3. Guide means as in claim 1, wherein the bilateral guides formed by said hook elements each operate according to at least two orthogonal planes.

4. Guide means as in claim 1, wherein said strap is of substantially rectangular cross-section and said groove, also of rectangular section, is formed on the lower surface of said strap, and wherein each of said hook guide elments engages the upper surface of the strap and the lateral surface thereof opposite the reed, as well as the lower surface of the strap, at least into the groove, and at least one of the lateral surfaces of said groove.

5. Guide means as in claim 4, wherein a groove is provided also on the upper surface of the straps, which thus have a double-T section, and wherein each hook guide element engages the lateral surface of the strap remote from the reed and the surfaces of said grooves and of their edges close to said lateral surface.

6. Guide means as in claim 5, wherein said hook guide elements are spaced from said edges.

* * * * *